US005248156A

United States Patent [19]

Cann et al.

[11] Patent Number: 5,248,156

[45] Date of Patent: Sep. 28, 1993

[54] ICE SKATE BLADE ASSEMBLY HAVING A REMOVEABLE RUNNER

[76] Inventors: Brian G. Cann, 12, Farmhouse Place, Chatham, Ontario, Canada, N7L 5C6; Richard C. Hampton, R.R. #1, King City, Ontario, Canada, L0G 1K0; Icaro Olivieri, 753, Lexington Avenue, Westmount, Quebec, Canada, H3Y 1K8

[21] Appl. No.: 748,450

[22] Filed: Aug. 22, 1991

[30] Foreign Application Priority Data

Feb. 15, 1991 [CA] Canada ..... 2036477

[51] Int. Cl.[5] ..... A63C 1/30

[52] U.S. Cl. ..... 280/11.18; 280/11.12

[58] Field of Search ..... 280/7.12, 7.13, 7.14, 280/7.15, 8, 11.12, 11.18, 11.3

[56] References Cited

U.S. PATENT DOCUMENTS

| | | | |
|---|---|---|---|
| 29,116 | 7/1860 | White et al. | 280/11.12 |
| 38,829 | 6/1863 | Johnson | 280/11.12 |
| 1,749,298 | 3/1930 | Orafsik | 280/11.18 |
| 2,108,128 | 2/1938 | Kinney | 280/11.18 |
| 2,130,641 | 9/1938 | Grubb | 280/11.12 |
| 2,150,964 | 3/1939 | Dornseif | 280/11.18 |
| 2,242,870 | 5/1941 | Prosey | 280/11.18 |
| 2,988,369 | 6/1961 | Rebicek | 280/11.12 |
| 3,947,050 | 3/1976 | Isely | 280/11.12 |
| 4,074,909 | 2/1978 | Baikie | 280/11.12 |
| 4,131,288 | 12/1978 | Wilson | 280/11.17 |
| 4,139,209 | 12/1977 | Humphreys | 280/11.12 |
| 4,218,069 | 8/1980 | Baikie | 280/11.12 |
| 4,223,900 | 9/1980 | Olivieri | 280/11.12 |
| 4,379,563 | 4/1983 | Arsenault | 280/7.1 |
| 4,932,675 | 6/1990 | Olson et al. | 280/7.13 |
| 5,088,749 | 2/1992 | Olivieri | 280/7.13 X |

FOREIGN PATENT DOCUMENTS

| | | | |
|---|---|---|---|
| 163636 | 7/1915 | Canada . | |
| 166373 | 11/1915 | Canada . | |
| 239918 | 5/1924 | Canada . | |
| 380906 | 4/1939 | Canada . | |
| 386541 | 1/1940 | Canada . | |
| 428202 | 6/1945 | Canada . | |
| 637948 | 3/1962 | Canada . | |
| 1053278 | 4/1979 | Canada . | |
| 1072994 | 3/1980 | Canada . | |
| 269583 | 3/1913 | Fed. Rep. of Germany . | |
| 724488 | 8/1942 | Fed. Rep. of Germany | 280/11.18 |
| 759294 | 5/1943 | Fed. Rep. of Germany . | |
| 313056 | 12/1933 | Italy | 280/11.18 |
| 223321 | 9/1942 | Switzerland | 280/11.18 |
| 3105 | of 1911 | United Kingdom | 280/11.18 |
| 2050845 | 1/1981 | United Kingdom | 280/11.18 |
| 90/09817 | 9/1990 | World Int. Prop. O. | 280/11.18 |

*Primary Examiner*—Brian Johnson

*Attorney, Agent, or Firm*—Ronald S. Kosie; Robert Brouillette

[57] ABSTRACT

An ice skate blade assembly which has a blade holder to which an ice skate runner is removeably secured; the runner may be preshaped and may be disposable. The runner is formed as a thin replaceable flexible strip arranged to be secured to the holder. Attachment elements are provided in the front and the rear of the holder to hold the strip in place and to create tension along the (entire) length thereof. The rear attachment element is adapted so that a hook pivotally engages a hook attachment element so as to hold the runner in place, tension being applied by a nut engaging a threaded portion of the hook attachment element.

13 Claims, 5 Drawing Sheets

ICE SKATE BLADE ASSEMBLY HAVING A REMOVEABLE RUNNER

FIELD OF THE INVENTION

This invention relates to ice skates and more particularly to an ice skate blade assembly and to a replaceable runner for same.

DESCRIPTION OF RELATED ART

Various attempts have been made to provide replaceable blades for ice skates. However, these prior art attempts have provided replaceable blades which have various drawbacks.

For example, the replaceable blades described in the following patents are secured in place with bolts, screws or the like, must therefore be rigid and require the use of relatively sophisticated tools to proceed with their replacement: Canada 239,918 (Beals & al); Canada 386,541 (Grubb); Canada 1,053,278 (Wilson); Canada 1,072,994 (Baikie); U.S. Pat. No. 1,749,298 (Orafsik); U.S. Pat. No. 2,242,870 (Prosey) and U.S. Pat. No. 4,379,563 (Arsenault). Canadian patent 428,202 (Howard) discloses a rigid replaceable blade having a rod shaped top portion which is slidable in a slot in the holder.

U.S. Pat. No. 2,988,369 (Rebicek) describes a replaceable blade of square cross section which has four (4) skating edges. It is held in place by being snapped into a groove.

U.S. Pat. Nos. 2,150,964 (Dornseif) and 4,218,069 (Baikie) disclose replaceable blades which are attached to the front portion of the holder by a hook and near the rear portion by a tension screw. The blades extend only over that part of the holders which actually contacts the ice and must be relatively rigid as they must be formed by stamping. There is no upwardly extending end portion as with the present invention so that the portion behind the tension screw is not tensioned. In any event, in the Dornseif design the blade strip is engaged by a screw part which straddles a rear end portion of the blade strip rib, and which is connected to an enlarged portion of this rib by means of some kind of cross pin. The need to provide an enlargement of the blade strip rib would be a significant drawback of this prior design, since it would mean that the blade strip could not be thin or be produced by a simple rolling or extruding procedure. By contrast, in the present invention, neither the front or rear fixing arrangements for the blade strip require any enlargement of the blade strip. Thus, the blade strip of this invention can be made by simple rolling or extrusion (if the material is suitable for extrusion), followed by removal of the rib at the front and rear end portions, and then forming the front end and the rear end into the appropriate configurations.

The blade strip of the present invention can also be quite narrow, for example the strip need be no wider than 3/16 inches (4.8 mm) and no deeper (excluding the rib) than ⅛ inches (3.17 mm); the rib itself will normally be less than 1/16 inches (1.6 mm) in both height and width. By contrast, in Dornseif the rib must be strong enough to receive all the tension applied by the screw means, which suggests that the overall dimensions of the Dornseif strip are much more than with the present invention, so that the latter strip would lack the flexibility of applicant's strip. Furthermore, if the Dornseif strip had the flexibility associated with the strip of this invention, the part of Dornseif's strip rear of the fixing means would tend to flap due to the absence of any tension thereon.

U.S. Pat. No. 3,947,050 (Isely) describes a removable blade which is also attached to the front portion of holder by a hook. However, the blade has a vertical thickness such as to resiliently yield only to a minor degree of flexing about a transverse axis. The curvature of the holder is greater than that of the blade such that the ends of the blade must be flexed upwardly on assembly so that the blade is resiliently self biased into mating relationship to the holder. A worm gear disposed at 90° in relation to the ice surface is used to create such bias by pulling the rear portion of the blade towards the holder. In contrast to the blade strip of this invention, Isely's must be strong and rigid enough to resiliently "yield to a minor degree of flexing" (C.2, L49-51) while maintaining "all parts of the blade securing means under load so as to prevent any free play of parts" and acting "somewhat as a lock washer" (C.4, L40-44). Indeed, the blade is held in place by the resiliently reaction of the blade to being flexed up by the worm gear. The strip of this invention must be longitudinally resilient but is not required to be resilient about a transverse axis.

German patentschrift 269,583 (Heine) discloses a thin replaceable sheet metal running edge which is pressed into a V-shaped section in the ice contacting area and which remains flat in the upwardly extending rear portion. Using a softer steel in order to make the part function as shown, the blade strip would be unacceptably soft and would not hold an edge nor stand up to impact loads which would fold the sheet metal into the groove or otherwise render the blade strip un-usable. The disclosed configuration is not adapted to work with today's harder steels, which are used in the manufacture of ice skate blades. Indeed, with today's harder steels, it would be impossible to achieve tension in the strip while creating a 180° turn at d-e. Furthermore, if such were possible, there would remain the serious difficulty resulting from the fact that harder steels tend to be brittle and could result in the breakage of the blade strip if the skate blade hits a hard obstacle or was hit by same.

In the International patent application no. PCT/CA90/00063 published on Sep. 7, 1990 as no. WO 90/09817, the inventors Cann and Hampton herein describe an attachment mechanism for a removable runner and generally point out various advantages of removable runner systems. A rear attachment mechanism described therein, however, exploits a runner having an upturned threaded rear end part which is rigidly fixed to the rest of the runner, i.e. it is integral with the rest of the runner. Because the threaded upturned part is rigidly fixed to the rest of the runner, areas of unacceptable stress may be produced; the degree of stress will depend on the extent to which the upturned part is bent out of its at rest position during use, the materials of construction, etc.. In any event, any such stress points in the runner are candidates for fracture in the event of strong impacts which may occur during use; especially if the runner is of hard (i.e. relatively brittle) material. Additionally, if it is desired to forwardly angle the upturned rear end part to conform to the corresponding shape at the rear of the holder, it can be difficult to insert the threaded part into the nut used to lock the runner in place at the rear of the holder.

SUMMARY OF THE INVENTION

It would be advantageous to have an ice skate blade assembly comprising a replaceable runner and a holder therefor wherein the runner may be attached to or removed from the holder readily and quickly.

Thus, in accordance with a general aspect, the present invention provides an ice skate blade assembly having a holder compressing a front end and a rear end, said holder carrying a replaceable runner formed as a flexible strip arranged to be secured to the holder, said runner having a front end portion, an ice contacting portion and a rear end portion, said rear end portion having an upwardly extending end part on which hook means is attached, front attachment means for securing the front end of the runner to the front end of the holder, and being characterized in that said assembly has hook attachment means which pivotally engages with said hook means, said hook attachment means having a screw threaded section, the rear end of the holder has an upwardly extending bore for receiving said screw threaded section, said bore being interrupted by a recess for seating a nut, said recess being open to the rear of the holder, and said assembly has a nut which, when threaded onto the screw threaded section of said hook attachment means, is capable of being rotated in said recess for tightening the runner on the blade assembly.

In accordance with the present invention, the blade holder may include a main portion (e.g. formed of a first plastics material) and a lower reinforcement portion (e.g. formed of material stronger than said first plastics material e.g. a metallic material) which provides a locating surface for the runner.

In accordance with the present invention, the front attachment means may comprise a bent over end part at the front end portion of the runner engageable with the front end of the holder. For example, the bent over end part may be a tightly curled (spring-like) front end part, and the front end of said holder may have a recess capable of receiving and resiliently retaining such curled front portion.

In accordance with the present invention, the front attachment means may comprise a coupling or retaining cylinder end part attached to the front end portion of the runner, and the front end of the holder may have a recess capable of receiving and retaining said coupling cylinder.

In accordance with a particular aspect, the present invention provides an ice skate blade assembly comprising a holder having a front end and a rear end, said holder carrying a replaceable runner formed as a flexible strip arranged to be secured to the holder, said runner having a front end portion, an ice contacting portion and a said front end portion, ice contacting portion and rear end portion defining a runner length, said front end portion having a rearwardly extending end over part engageable with the front end of the holder, said rear end portion having an upwardly extending end parts on which hook means is attached, and being characterized in that said assembly has hook attachment means which pivotally engages with said hook means, said hook attachment means having a screw threaded section, the rear end of the holder has an upwardly extending bore for receiving said screw threaded section, said bore being interrupted by a recess open to the rear of the holder for seating a nut, and said assembly has a nut which, when threaded onto the screw threaded section of said hook attachment means, is capable of being rotated in said recess for tightening the runner on the blade assembly so as to longitudinally tension the runner along its length e.g. its entire length from the rear attachment to the front attachment.

In accordance with the present invention, the holder as mentioned above may include a main portion formed of a first plastics material and a lower reinforcement portion which is formed of material stronger than the first plastics material and which provides a locating surface for the runner. The front end of such a holder may have a recess and the rearwardly extending bent over end part may be engageable in the recess; the recess may, for example, be defined by said main portion and said reinforcement portion of said holder.

In accordance with the present invention, the runner and holder may have mating tongue and groove means interlocked along their interface to preserve lateral stability. Such means may be a central upwardly projecting rib for locating in a groove in the blade holder, e.g. the runner may have a main part surmounted by a longitudinally extending rib.

The dimensions of said runner when made of high carton steel, excluding the rib, may be in the order of up to 4 mm wide and up to 3 mm deep, (preferably, in the order of ⅛ inches (3.0 mm) wide and 1/16 inches (1.6 mm) deep). In any event the dimensions should be such as to allow a proper lateral stiffness while maintaining longitudinal resiliency.

In accordance with the present invention the hook means and the hook attachment means may take any configuration as long as they are configured for pivotal engagement i.e. a pivotal freedom of movement which will facilitate the installation of the runner. Such pivotal freedom of movement may also relieve or attenuate stress which may otherwise be applied to the rear end part of the runner and contribute to breakage of the runner at the rear end thereof as a result of the runner being subjected to impact forces during use. Thus, in accordance with the present invention the hook means may, for example, have a portion having a T-like end part which matingly engages with the hook attachment means; alternatively the hook attachment means may have a T-like end part which matingly engages with the hook means; other types of analogous hooking elements may be used keeping in mind the previous comments with respect to pivotal engagement.

In accordance with the present invention any type of nut means may be used for the nut as long as it meets the functional requirements mentioned herein. Thus, for example, the nut used must be rotatable in the recess; it may have a knurled exterior surface, surface slots, surface projections, etc.

A (rear) attachment mechanism preferably is configured so that it can exert a broad range of longitudinal (tension) force on any particular runner when tightening the runner onto the holder. The rear pivotal engagement mechanism of the present invention may facilitate the use of relatively small angles between the rear end of the runner and the ice contact portion thereof (e.g. angles of less than 90 degrees as shall be described hereinafter); the use of such small angles may provide for a strong tension force exerted by a pulley-like mechanical joint/attachment. In this respect the runner, being formed as a flexible strip, can be shaped to follow the contour (i.e. radius) of the rear end of the holder.

In accordance with the present invention, the effective blade height and shape will not be altered by installing a new runner. With conventional skates, the shape will change and the height will decrease with each sharpening. The rocker, or front to back shape of the blade can be modified to the skater's preference by grinding the holder's bottom edge. The replacement runner may be then tensioned tightly across this edge and conforms to its shape.

Significant weight savings may be realized with the assembly of the present invention as a large section of conventional blades which is required to allow for future sharpening is no longer needed. If required, lateral stability may, as described herein, be enhanced by providing a reinforced section extending along the lower edge of the holder.

Such replaceable runners may be sold pre-sharpened with a consistent, highly polished quality sharpness, and packaged in pairs. The runners should provide a sharpness which lasts at least as long as that of conventional skate blades. In order to accommodate the various sizes of ice skate boots and their corresponding blade lengths, the blade holder and runners also have to be produced in the various lengths to suit.

BRIEF DESCRIPTION OF THE DRAWINGS

The invention will be further described with reference to drawings which illustrate example embodiments of the invention, and in which.

DETAILED DESCRIPTION OF EXAMPLE EMBODIMENTS

Figure 1:
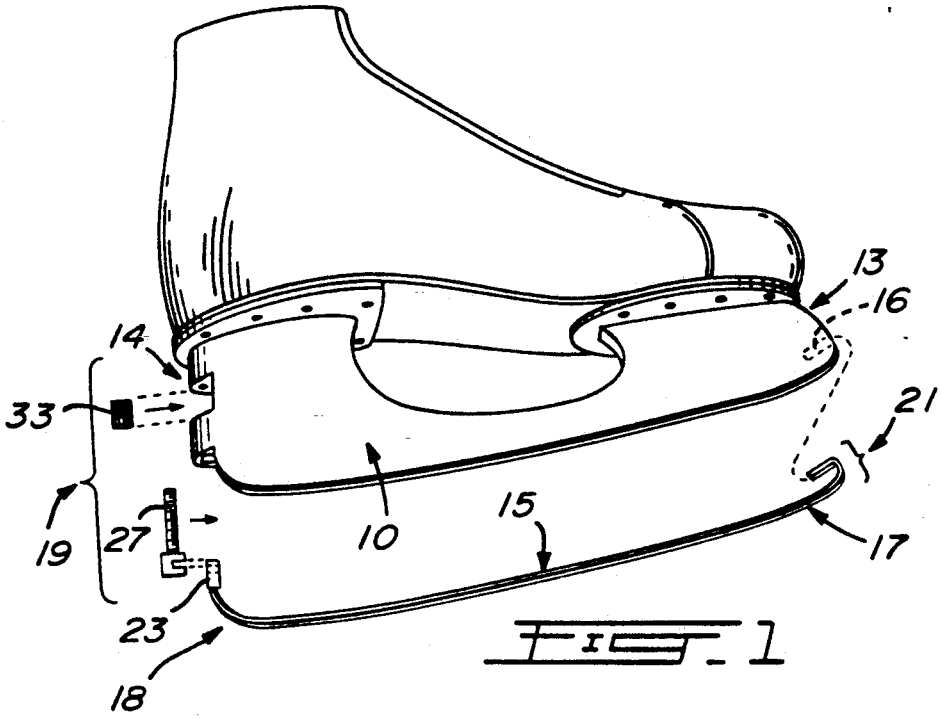
FIG. 1 is a perspective view of an ice skate incorporating an embodiment of a blade assembly with an example runner shown separately.

In the drawings the same reference numerals shall, so far as possible, refer to the same elements.

As shall be seen a blade assembly in accordance with the present invention may have a holder, a runner or blade strip, a front holding means and a rear holding means.

Referring to FIGS. 1 to 3A, the holder, designated generally the reference numeral 10, is similar in style and purpose to a conventional skate blade holder which attaches to the sole of the skate boot and holds a blade. Although in this invention no blade as such is required, the term "blade holder" or "holder" will be used herein for part 10 as a matter of convenience.

The holder 10 may be of a molded plastics material or composition and configured to allow for proper attachment to the skate boot. The preferred plastics material is Dupont "ZYTEL ST 801" (trade mark), a nylon impregnated resin.

In order to provide the lateral strength required for ice skates, the holder 10 may comprise a main portion 11 and a lower reinforcement portion 12. The main portion 11 may, for example, be of a plastics material (as mentioned above) while the lower reinforcement portion 12 is preferably molded into the plastics material of the main portion 11 along the lower edge thereof; in FIG. 2 the lower reinforcement portion is outlined in the body of the main portion 11 by the dotted line **12*a*. The lower reinforcement portion 12 may be made of a material (e.g. carbon steel, carbon fiber, etc.) which provides the proper amount of rigidity without being brittle and which is considerably stronger than the plastics material of the main portion 11 of the holder. As seen from FIGS. 2 and 3 the lower reinforcement portion 12** may take the form of a suitably shaped bar.

Running the length of the underside of the holder 10, and extending up the front and rear ends thereof, (the front end of the holder being indicated generally by the reference numeral 13 and the rear end thereof by the reference numeral 14), is a square-sectioned groove with which the runner (or blade strip), indicated generally by the numeral 15, is adapted to mate.

This groove is deeper than a correspondingly shaped protrusion **15*b* on the runner 15 (as shall be described in more detail below). This ensures that the runner will be centered by vertical sides on the protrusion 15*b* acting against sides of the groove, and ensures that the weight bearing edges of the runner 15 are properly located at the sides of the groove. The groove is also deep enough to allow material to be removed from the lower surface of the holder 10 when adjusting its shape (e.g. the shape of the lower reinforcement portion 12), while still providing a clearance (see below) between the bottom of the groove and the protrusion 15*b* on the blade strip 15**.

Figure 3:
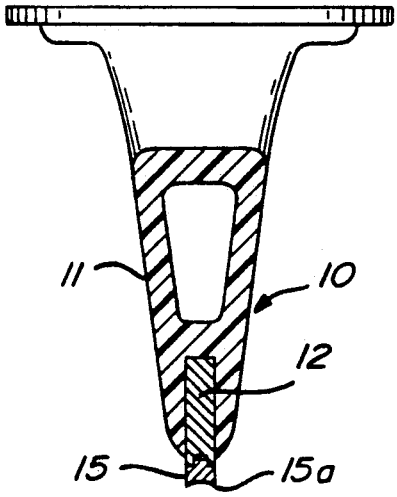
FIG. 3 is a cross-sectional View on line 3—3 of FIG. 2.
Figure 3A:
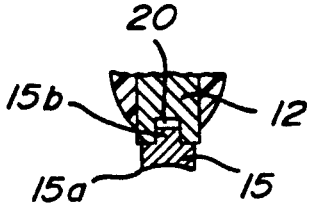
FIG. 3A is an enlarged detail of the parts shown in FIG. 3.

As may be seen from FIG. 3A, the lower reinforcement portion 12 may be provided with the desired groove.

The front end 13 of the holder 10 is provided with a hole (or other suitable recess) 16 for engagement with the front end portion 17 of the runner 15 as shall be described hereinafter. There is also provision on the rear end 14 of the holder 10 for attachment of the rear end portion 18 of the runner 15 (i.e. by means of a retaining mechanism indicated generally by the reference numeral 19 (described further below)).

Figures 4, 5, 6, 7, 8:
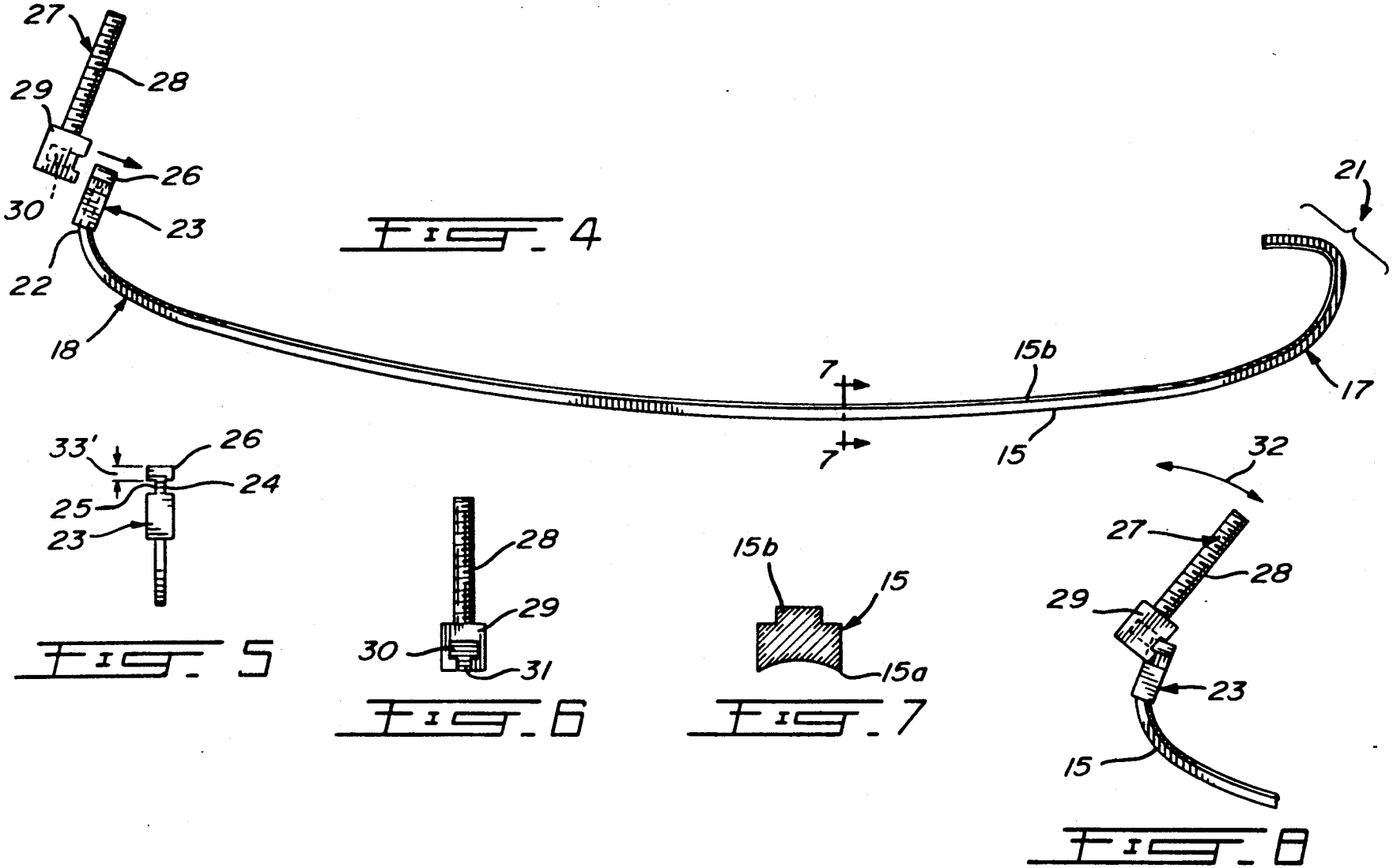
FIG. 4 is a side view of a runner and elements of a rear hooking mechanism in accordance with the present invention.
FIG. 5 is a rear view of the runner shown in FIG. 4.
FIG. 6 is a front view of the hook attachment means shown in FIG. 4.
FIG. 7 is a cross-sectional view on line 7—7 of the runner shown in FIG. 4.
FIG. 8 is a partial view of the runner shown in FIG. 7, showing pivotal engagement between with the hook means and the hook attachment means.

Referring to FIGS. 4 and 7, the runner 15, is a thin strip which is sized to run the length of the lower edge of the holder 10. The runner 15 is strong enough to hold the sharp lower edges 15*a* while being flexible enough to conform to the shape of the blade holder 10 when suitably tightened or tensioned by the retaining mechanism 19 at the back of the holder.

The runner 15 can be made of any suitable material (ie. stainless steel, carbon steel, engineering plastic, etc. . . ) which has the above mentioned characteristics and will hold a sharp edge when skated upon; the runner may, for example, have a rockwell hardness of 48.7° C.. As shown in FIG. 7, the blade strip can be made of material having a different hardness around its periphery while having a central or core portion of lower hardness. For example, the core may have a rockwell hardness of 12 to 20, while the outer portion could have a hardness of 50 to 75 rockwell. This allows the blade strip to have very hard skating edges while not being brittle.

In an example embodiment, the strip may be in the order of ⅛ inch (3.0 mm) wide by 1/16 inch (1.6 mm) deep, and may be formed of high carbon steel.

As mentioned above, the top of the runner 15 has a protrusion or rib 15*b* running the length of the strip which fits into the corresponding square-sectioned groove in the holder for providing lateral stability. The groove and the protuberance 15*b* are sized such that a clearance space 20 (see FIG. 3A) is provided between the top of rib 15*b* and the bottom of the groove, so that the surfaces of the runner 15 beside rib (or protrusion) 15*b* are always in firm contact with the bottom of the holder 10. The protrusion 15*b* and the groove may have any other corresponding shapes as long as laterally the blade is secure and remains flat to the holder 10; preferably however the rib 15*b* is in the form of a square-sectioned rib (e.g. a rib 1 mm wide).

Figure 2:
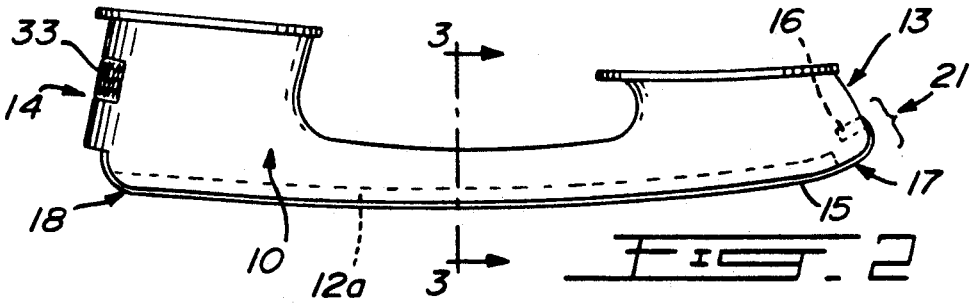
FIG. 2 is a side view of the blade assembly shown in FIG. 1, with the runner in place.

The blade assembly is provided with front attachment means for securing the front end portion of the runner 10 to the front end 13 of the holder 10. Thus, the front end 17 of the blade strip 15 illustrated in FIG. 4, is provided with a front end portion having a rearwardly extending bent over end part which defines a hook which engages the hole 16 at the front end 13 of the holder 10. This hook is sufficiently resilient to provide relief for over-tightening when installed while maintaining adequate tension (which will vary according to the material used for the runner) on the strip in other situations when the runner may be loosened or tightened. It is to be noted that the hook at the front end portion of the runner 15 as shown in FIGS. 1 and 4 has a relatively long radius whereas the runner 15 in FIG. 2 is shown with a hook having a short radius. A hook with a long radius is more advantageous since it will expose the part of the runner in the area of curvature to less stress during use. Other examples of front attachment means will be described below with respect to FIGS. 13, 14 and 15.

The blade assembly is also provided with rear attachment means for securing the rear end portion 18 of the runner 10 to the rear end 14 of the holder 10. The holder 10 and the fixing mechanism 19 at the back of the holder are suitably configured so that sufficient tension and travel may be provided to hold and firmly "lock" the runner 15 in place; for example, the rear end is shown with a curved end part over which the runner may be tensioned. Excessive tension or travel are not required to properly secure the blade strip to the blade holder. The exact tension required will vary according to the material used for the runner.

Thus, the rear end portion 18 of the runner 15 has a rear upwardly extending end part 22 on which hook means 23 is mechanically attached, glued, welded or otherwise attached in a manner suitable for the purposes herein. The hook means 23 is provided with a terminal end portion which has opposed recesses (one of which is designated with the reference numeral 24 in FIG. 5) on either side of a neck 25; the neck 25 links a head part 26 to the rest of the hook means 23. The hook means 23, thus has a terminal end part having a T-like configuration.

The hook means 23 is engageable with the hook attachment means which is indicated generally by the reference numeral 27. The hook attachment means 27 has a screw threaded portion 28 to which is attached a body 29. The body 29 is provided with a recess 30 and a slot 31. The recess 30 is sized to receive the head part 26 of the hook means 23 whereas the slot 31 is sized to receive the neck 25 of the hook means 23. The hook means 23 and the hook attachment means 27 are adapted or configured to be pivotally attached so that the hook attachment means 27 has a freedom of movement such that it may pivot back and forth with respect to the hook means 23 as shown by the direction arrow 32 in FIG. 8. For this purpose the thickness (designated by the reference numeral 33' in FIG. 5) of the head part 26 is smaller than the corresponding dimension of the recess 30 of the body 29; similarly the recesses 24 on either side of the neck 25 of the hook means 23 are sized larger than the side elements of the body 29 which define the slot 31 thereof. Since the rear attachment means has a pivotal freedom of movement, this movement can facilitate the attachment of the runner to the holder when the front attachment means is already engaged; especially when the frontwardly open angle which is defined by the bore is less than ninety degrees (see angle "c" in FIG. 9). The pivotal freedom of movement may also attenuate stress which may otherwise be applied or transmitted to the rear end of the runner if the fixation was stiff or rigid i.e. stress which may be developed during and after attachment of the runner to the blade holder.

The screw threaded portion 28 (of the hook attachment means 23) is itself engageable by a nut 33 held or seated in a recess in the rear of the holder 10; see FIGS. 1 and 2. For the purposes of further discussion, however, reference will be made to the modified holder 110 shown in FIGS. 9 to 12.

Referring to FIGS. 9 to 12, the modified holder 110 is similar to holder 10 described above in having a main portion 111 of molded plastic construction and in having a lower reinforcement portion 112 (similar to section 12 described above) and which is formed of material stronger than the plastics material of the main holder part 110. The lower reinforcement section 112 is, however, more pronounced than section 12 described above. The modified holder 110 also differs from the holder 10 in that the front of part 113 has a hole 116 (or recess) which is defined by the main portion 111 and the lower reinforcement portion 112. The rear attachment mechanism is, however, the same for both holders 10 and 110.

As mentioned above, the rear attachment mechanism includes a nut 33. The nut 33 is held or seated in a recess 34 in the rear of the holder 110. The nut 33 is cylindrical in shape and has a knurled exterior and side slots 35. The nut 33, recess 34 and side slots 35 are sized or configured so as to allow the nut 33 to be rotated in the recess 34 solely with the fingers or if necessary with the aid of a coin or the like inserted in a slot; alternatively, the slots may be replaced by spaced apart longitudinally disposed protrusions sized so as to facilitate inducement of rotation by (solely) the thumb or other finger. As may be seen in FIG. 10 a washer 36 is provided to facilitate rotation.

Figure 9:
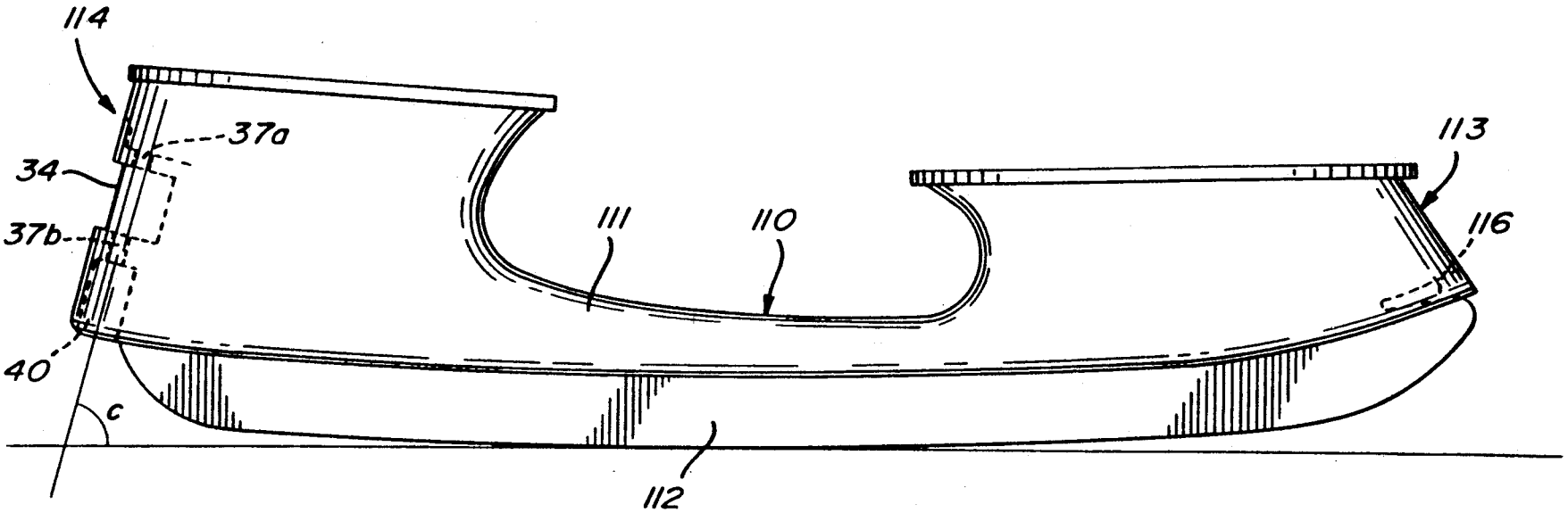
FIG. 9 is a side view of another embodiment of a holder in accordance with the present invention, without a runner attached thereto.
Figure 10:
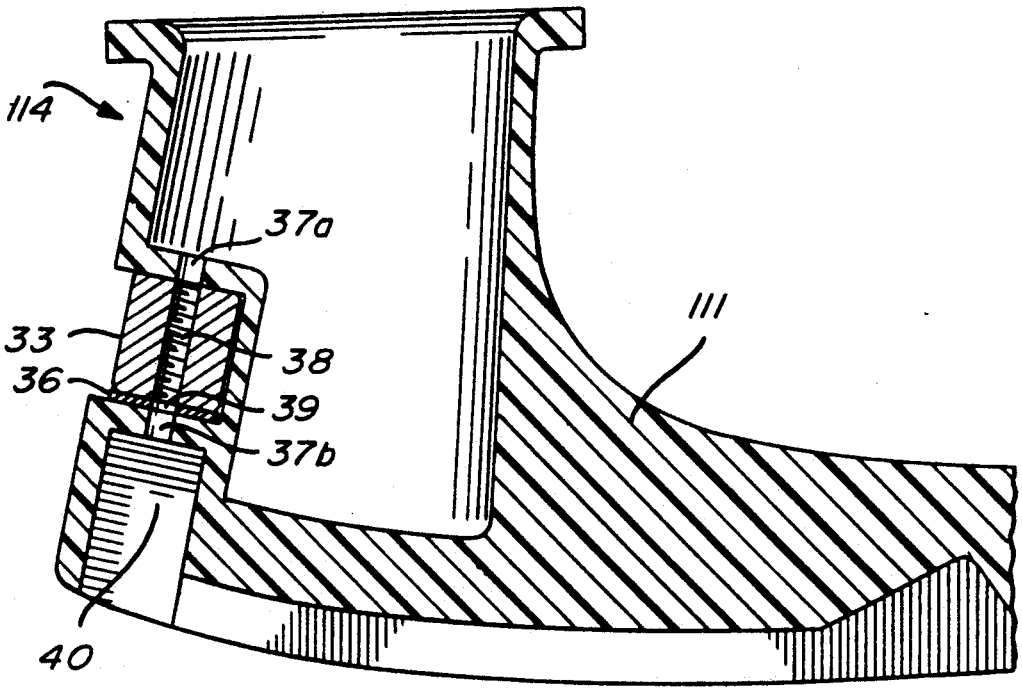
FIG. 10 is a partial sectional side view of the holder shown in FIG. 9 without the lower reinforcement portion.
Figure 11:
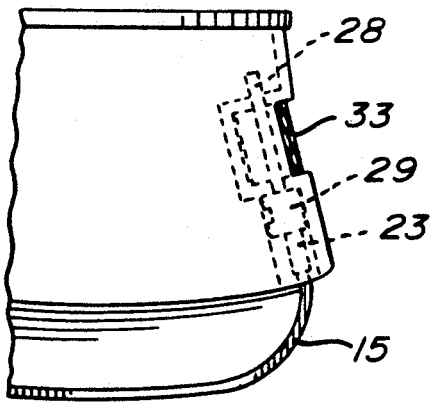
FIG. 11 shows an enlarged side view of the rear end of the modified holder shown in FIG. 9 with the runner of FIG. 4 attached thereto.
Figure 12:
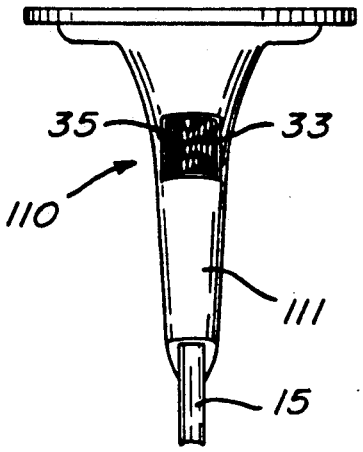
FIG. 12 is a rear view of the blade assembly shown in FIG. 11.
Figure 11A:
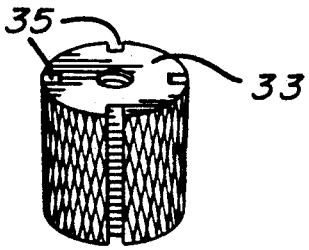
FIG. 11A shows an enlarged perspective view of a nut used to hold the runner.

The rear end 114 of the holder 110 is as mentioned above provided with a recess 34 (see for example FIG. 9). The recess 34 is open to the rear of the holder 110 and communicates with a bore. The bore extends up inside the rear end of the blade holder, roughly parallel to its rear edge. The bore is interrupted by recess 34 such that the bore is divided into parts 37*a* and 37*b*, (sometimes hereinafter referred to collectively as the bore). The recess 34 and the bore are configured such that with the nut 33 and washer 36 being seated in the recess, the respective holes 38 and 39 thereof may line up with the bore. The bore is suitable for receiving the threaded portion 28 of the hook attachment means 27, the diameter of the bore being somewhat larger than the diameter of the threaded portion 28 so as to provide a (small) clearance therebetween.

The (frontwardly open) angle between the bore and the tangent of the central reinforcement 112 (shown as "c" in FIG. 9) may vary over a wide range such as, for example, from about 60 to about 120 degrees; the angle "c" may, more particularly, for example, be greater than 60° and smaller than 90°.

The bore portion 37*b* communicates with an expanded recess 40. The recess 40 is sized so as to receive and cover the hook means 23 and the body 29 of the hook attachment means 27. The recess 40 protects the fixation mechanism from being damaged if hit as well as acting as safety protection for objects which may come in contact with the back of the skate blade.

To install the runner 15 on the holder 110, the hook provided at the front end 17 of the runner 15 may be introduced into recess 116; the head part 26 of the hook means 23 may then be introduced into recess 30 of hook attachment means 29. Thereafter, the threaded portion 28 of hook attachment means 27 (with the rest of the elements in tow) may be passed through the recess 40 and introduced into the bore part 37*b*. With the nut 33 (and washer 36) previously disposed in recess 34, the nut 33 may be threaded onto the threaded portion 28 of hook attachment means 27 to pull the runner 15 into place with the upper part of the threaded portion 28 eventually passing through bore part 37*a* (see FIG. 11). As previously described, the nut 33 has side slots 35 which allow the nut to be firmly rotated by insertion of an implement or coin. This tightening draws the blade strip into place on the blade holder and insures that it is tensioned throughout its entire length and bedded down tightly in the blade holder slot along the length of the blade strip.

Figure 13:
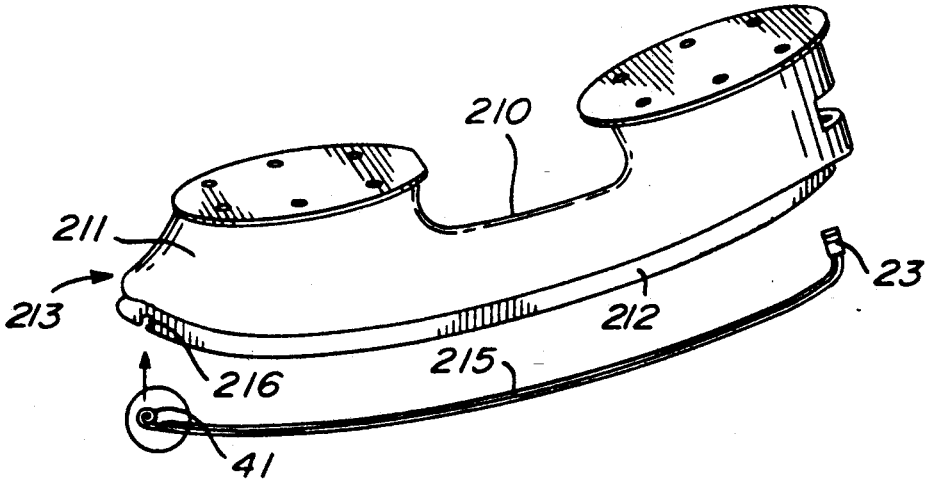
FIG. 13 shows a perspective view of a further embodiment of a blade holder with another example runner shown separated.
Figure 13A:
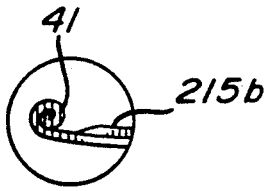
FIG. 13A shows an enlarged view of a tightly curled spiral spring front end part of the runner shown in FIG. 13.

Referring to FIG. 13, the disclosed holder 210 is similar to holder 110 described above i.e. it has a main portion 211 and a lower reinforcement portion 212. The holder 210 differs from the holder 110 in that:

The front of part 213 has (instead of hole 116) a recess 216 disposed in the lower reinforcement portion 212. The interior surfaces of recess 216 are generally cylindrical and surround a normally horizontal axis. These surfaces are suitable for retaining a tight (spring-like) roll 41 of the material forming the runner 215 but which lacks the rib 215*b* which runs along the major length of the runner 215. The roll 41 can be inserted by sideways sliding into the recess 216 which has a suitable bottom opening allowing a stem of runner material connecting the roll 41 to the rest of the runner 215 to pass through while resiliently retaining the roll 41. The roll acts like a spring like anchor allowing somewhat more resilience than the hook since the roll can unwind slightly like a spring; this accommodates variations in length due to the holder shape, allowing for shape adjustment of the holder by grinding.

Figure 14:
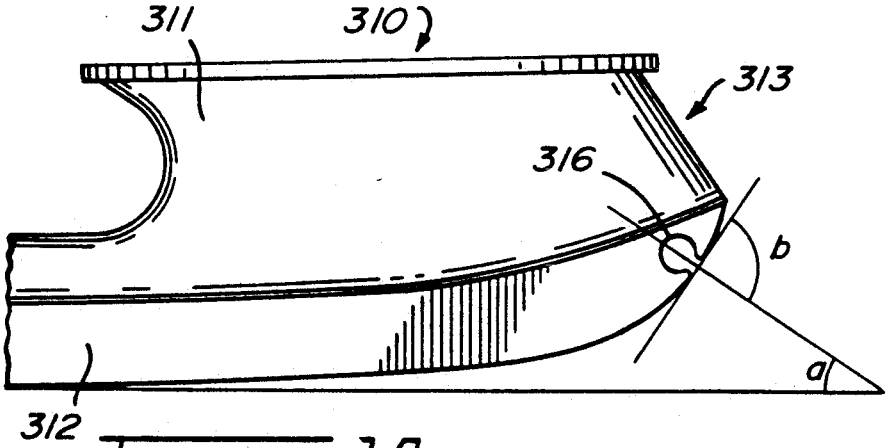
FIG. 14 shows an side view of the front end of a further example of a blade holder.
Figure 15:
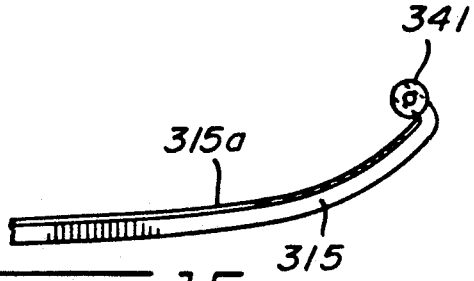
FIG. 15 shows an side view of the front end portion of a further example of a runner for use with the holder shown in FIG. 14.

Referring to FIGS. 14 and 15, the disclosed holder 310 is similar to holder 110 described above i.e. it has a main portion 311 and a lower reinforcement portion 312. The holder 310 differs from the holder 110 in that:

The front of part 313 of the holder has a recess 316 disposed in the lower reinforcement portion 312. The interior surfaces of the recess 316 are generally cylindrical and surround a normally horizontal axis. These surfaces are suitable for retaining cylinder 341 which is mechanically attached, glued or welded to the front of the runner 315. The cylinder 341 can be inserted by sideways sliding into the recess 316 which has a suitable bottom opening allowing a stem of runner material connecting the roll 341 to the rest of the runner 315 to pass through while resiliently retaining the cylinder 341. The cylinder 341 acts as an anchor.

With respect to the recess 316, the center line thereof may form an angle (shown as "b" in FIG. 14) of between 70° and 130° and preferably of 90° while the angle between said center line and the tangent of reinforcement part 312 (shown as "a" in FIG. 9) may be between 45° and 90° and preferably 65° the cylinder is of course attached to the runner 315 so as to take into account the angle used.

The runners shown in FIGS. 13, 14 and 15 may be installed on the respective holders at the rear end thereof in a manner analogous to that discussed above.

Having now described and illustrated three forms of this invention, it is to be understood that the invention is not to be limited to the specific forms or arrangement of parts shown and described herein.

We claim:

1. An ice skate blade assembly comprising a holder having a front end and a rear end, said holder carrying a replaceable runner formed as a flexible strip arranged to be secured to the holder, said runner having a front end portion, an ice contacting portion and a rear end portion, said rear end portion having an upwardly extending terminal end part on which hook means is attached, front attachment means for releasably securing the front end of the runner to the front end of the holder, and being characterized in that said assembly has hook attachment means for releasable engagement with said hook means, said hook attachment means having a screw threaded section, the hook attachment means and the hook means being configured to permit a pivot connection therebetween, the rear end of the holder has an upwardly extending bore for receiving said screw threaded section, said bore having opposed ends, said bore being interrupted between said opposed ends by a recess for seating a nut, said recess being open to the rear of the holder, said assembly has a nut which, when threaded onto the screw threaded section of said hook attachment means, is capable of being rotated in said recess for releasably tightening the runner on the blade assembly.

2. An ice skate blade assembly according to claim 1, wherein the holder has a main portion and a lower reinforcement portion, said lower reinforcement portion providing a locating surface for said runner.

3. An ice skate blade assembly according to claim 2, wherein said runner has a main part surmounted by a longitudinally extending rib.

4. An ice skate blade assembly according to claim 2, wherein said main portion is formed of a first plastics material and said lower reinforcement portion is formed of a material which is stronger than said first plastics material.

5. An ice skate blade assembly according to claim 4, wherein said lower reinforcement portion is formed of a metallic material.

6. An ice skate blade assembly according to claim 1, wherein said front attachment means comprises a bent over end part at the front end of the runner engageable with the front end of said holder.

7. An ice skate blade assembly according to claim 6, wherein said bent over end part is a tightly curled spiral spring front end part, and wherein the front end of said holder has a recess capable of receiving and resiliently retaining said curled front end part.

8. An ice skate blade assembly according to claim 1, wherein said front attachment means comprises a retaining cylinder end part attached at the front end portion of the runner, and wherein the front end of said holder has a recess capable of receiving and retaining said retaining cylinder end part.

9. An ice skate blade assembly comprising a holder having a front end and a rear end, said holder carrying a replaceable runner formed as a flexible strip arranged to be secured to the holder, said runner having a front end portion, an ice contacting portion and a rear end portion, said front end portion, ice contacting portion and rear end portion defining a runner length, said front end portion having a rearwardly extending bent over end part releasably engageable with the front end of the holder, said rear end portion having an upwardly extending terminal end part on which hook means is attached, and being characterized in that said assembly has hook attachment means for releasable engagement with said hook means, said hook attachment means having a screw threaded section, the hook attachment means and the hook means being configured to permit a pivot connection therebetween, the rear end of the holder has an upwardly extending bore for receiving said screw threaded section, said bore having opposed ends, said bore being interrupted between said opposed ends by a recess open to the rear of the holder for seating a nut, and said assembly has a nut which, when threaded onto the screw threaded section of said hook attachment means, is capable of being rotated in said recess for releasably tightening the runner on the blade assembly so as to longitudinally tension the runner along said length.

10. An ice skate blade assembly according to claim 9, wherein the holder includes a main portion formed of plastic and a lower reinforcement portion which is formed of material stronger than said plastic and which provides a locating surface for said runner.

11. An ice skate blade assembly according to claim 9, wherein the front end of said holder has a recess and wherein said rearwardly extending bent over end part is engageable in said recess.

12. An ice skate blade assembly according to claim 10, wherein the front end of said holder has a recess, wherein said rearwardly extending bent over end part is engageable in said recess and wherein said recess is defined by said main portion and said reinforcement portion of said holder.

13. An ice skate blade assembly according to claim 12, wherein said hook means has a portion having a T-like cross section which matingly engages with said hook attachment means.

* * * * *